United States Patent [19]

Park

[11] 4,222,860

[45] * Sep. 16, 1980

[54] METHOD FOR THE BENEFICIATION OF ORE

[76] Inventor: Moon C. Park, 105 Cal La., Sparks, Nev. 89431

[ * ] Notice: The portion of the term of this patent subsequent to Oct. 10, 1995, has been disclaimed.

[21] Appl. No.: 915,564

[22] Filed: Jun. 14, 1978

Related U.S. Application Data

[62] Division of Ser. No. 721,988, Sep. 10, 1976, Pat. No. 4,119,532.

[51] Int. Cl.[2] ..... B03B 5/60

[52] U.S. Cl. ..... 209/159; 209/18; 209/465

[58] Field of Search ..... 209/17, 158–159, 209/168–169, 250, 454, 460–461, 463–465, 13, 18

[56] References Cited

U.S. PATENT DOCUMENTS

| | | | |
|---|---|---|---|
| 1,917,156 | 7/1933 | Rauschenbusch et al. | 209/18 |
| 1,966,001 | 7/1934 | Burke et al. | 209/158 |
| 2,605,220 | 7/1952 | Logan | 210/319 |
| 2,767,847 | 10/1956 | Russell et al. | 210/219 |
| 3,261,559 | 7/1966 | Yavorsky et al. | 241/24 |
| 3,280,975 | 10/1966 | Evans | 209/158 |
| 3,351,195 | 11/1967 | Hukki | 209/158 |

FOREIGN PATENT DOCUMENTS

| | | | |
|---|---|---|---|
| 96217 | 5/1919 | Austria | 209/169 |
| 539630 | 11/1931 | Fed. Rep. of Germany | 209/169 |

*Primary Examiner*—Robert Halper

*Attorney, Agent, or Firm*—Fulwider, Patton, Rieber, Lee & Utecht

[57] ABSTRACT

Severed metal bearing ore is placed in a vessel having a water inlet at the bottom and an outlet at the top. A propeller causes water to flow upwardly through the vessel and to be discharged through the outlet carrying gangue with it. Concentrate, which is heavier because it contains the metal to be recovered, does not rise to the level of the outlet and therefore remains in the vessel. To achieve better vertical separation of the gangue and concentrate, a horizontal screen is positioned above the propeller to equalize pressure and inhibit rotational flow in the upper portion of the vessel.

5 Claims, 3 Drawing Figures

METHOD FOR THE BENEFICIATION OF ORE

RELATED APPLICATIONS

This is a division of application Ser. No. 721,988, filed on Sept. 10, 1976 now U.S. Pat. No. 4,119,532, entitled BENEFICIATION APPARATUS AND METHOD.

BACKGROUND OF THE INVENTION

The present invention relates to a beneficiation method, and particularly to such apparatus and methods in which the difference in the specific gravity of gangue and concentrate is utilized to achieve separation of severed ore.

Run-of-the-mine ore is usually too great in bulk and weight to permit shipping without initial processing at the mine to concentrate sought-after metals into a product of smaller bulk. The first step in conventional mine site processing is severance, in which the ore is comminuted by crushing, usually in several phases. The next step is beneficiation in which the severed ore is separated into concentrate, in which the metal is found, and gangue (also known as tailing), which is a waste product. The concentrate is then shipped to a refinery where pure metal is liberated by chemical or thermal means.

The profitability of a mine is often dependent upon the cost of beneficiation, and many mines that would yield low grade ore are not worked because of the high expense that this process would entail if known techniques were employed. Copper and precious metals, for instance, are often present in such low grade ore.

A common method of beneficiation used to recover such metals is called tabling. The severed ore is introduced onto a reciprocating deck which is continuously washed by a water film, the reciprocation of the deck being at right angles to the water flow. As the ore moves across the deck, the gangue and concentrate are stratified owing to the difference in their specific gravities, and the concentrate is trapped by riffles of successively increasing length raised on the surface of the deck.

Another known method of beneficiation applicable to severed metal ore is called sink-float separation. The ore is introduced into a suspension having a specific gravity higher than the gangue but lower than the metal. The suspension is stirred in a rotary fashion as it flows through a conically shaped vessel. The gangue tends to float across the top of the vessel and out the opposite side, while the concentrate sinks and is discharged through the pointed lower end of the vessel. In this, as in other beneficiation processes, the metal is not recovered in pure form nor is the gangue completely free of metal. The metal is, however, present in the concentrate in a much higher proportion than in the beneficiated ore, and the proportion of metal found in the gangue should be very small.

Known beneficiation techniques are often time-consuming, labor intensive and costly. The principle objective of the present invention is to provide a new and different beneficiation apparatus and method capable of processing severed ore within a short period of time, using less labor, and at a greatly reduced cost.

SUMMARY OF THE INVENTION

The present invention is embodied in a method by which severed ore is separated into gangue and concentrate. It relies on the difference in specific gravity between these two ore components, but in a manner completely different from previously known beneficiation techniques.

The apparatus employed is a generally upright vessel with a water inlet at the bottom and an outlet at the top. Severed ore is placed in the vessel and water is then forced to flow upwardly from the inlet to the outlet by the rotation of a propeller near the bottom of the vessel. The lighter gangue is carried upwardly by the flow and pressure of the water to the level of the outlet where it is discharged. The heavier metal, although propelled from the bottom of the vessel, does not rise to the level of the outlet and thus remains in the concentrate at the bottom.

To improve the vertical separation of the gangue and concentrate, a screen is placed horizontally across the vessel between the propeller and the outlet, preferably one-third of the distance from the bottom of the vessel. The function of the screen is to equalize the water pressure and inhibit rotational flow in the portion of the vessel above the screen. After the gangue has been separated in this manner, the concentrate can also be removed through the outlet by a suction pump.

If the severed ore has coalesced into large clumps or includes foreign matter such as leaves and twigs, it can be placed on top of the screen and the propeller run at high speed as a preliminary step. The forceful upward flow of water through the screen will break up the ore, which will sink through the screen and settle at the bottom of the vessel leaving the larger pieces of foreign matter behind. The screen is then temporarily removed and the foreign matter discarded before the separation process described above is begun.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 1:
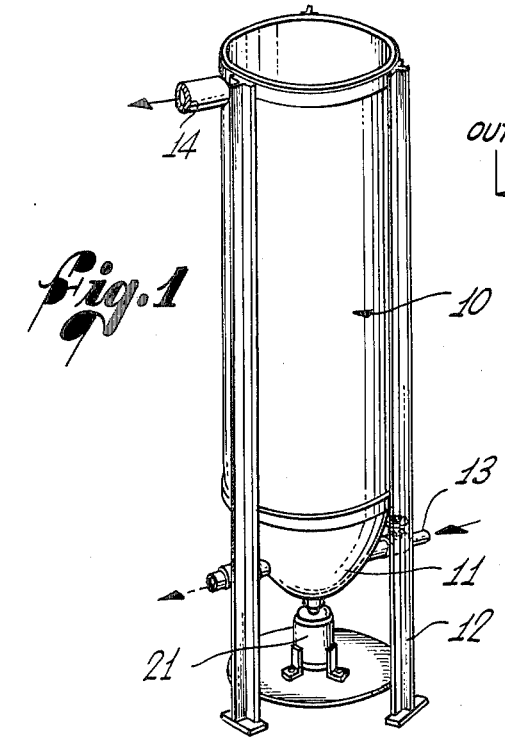
FIG. 1 is a partially broken-away perspective view of a beneficiation apparatus that embodies the invention.
Figure 2:
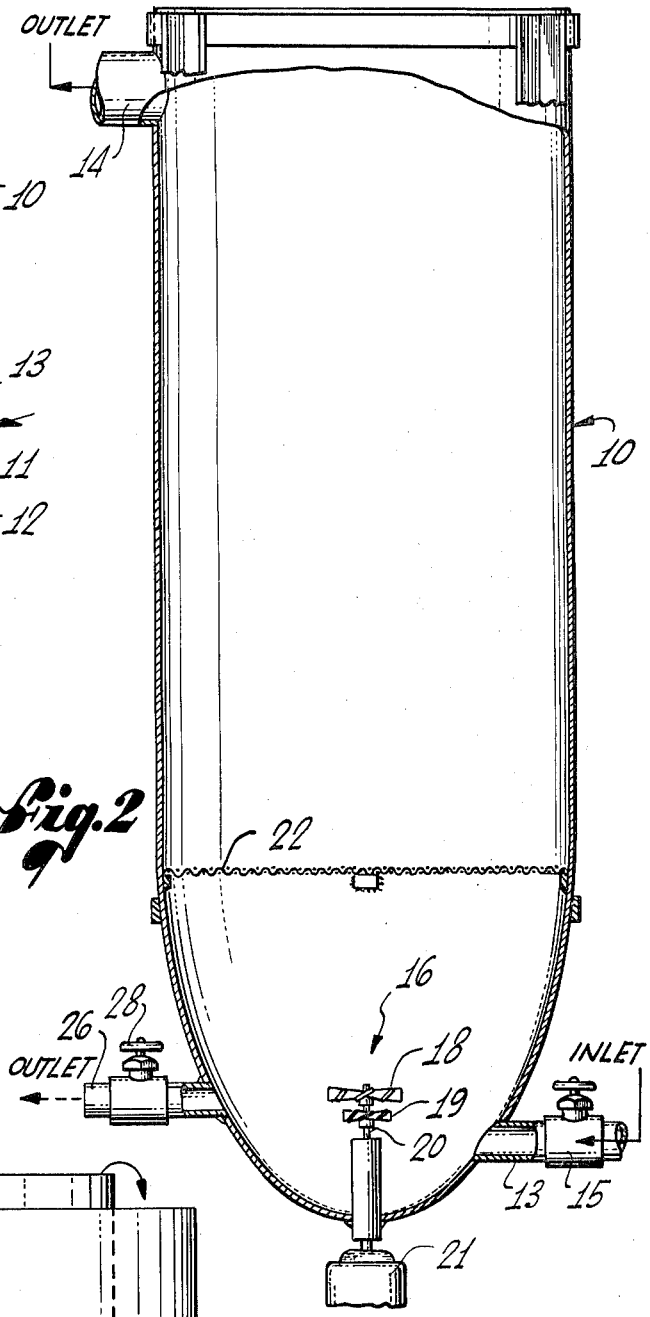
FIG. 2 is an enlarged cross-sectional side view taken substantially through the middle of the apparatus of FIG. 1.

The beneficiation apparatus of the invention is used to separate concentrate from the gangue of severed ore to recover metals such as copper and precious metals. It is capable of economically processing large quantities of ore within a relatively short time period. The exemplary apparatus, illustrated in FIGS. 1 and 2 of the drawings, includes an open top vessel 10 that is generally cylindrical, having a vertical longitudinal axis and a lower end 11 that is elliptical in cross-section. The vessel is supported in an upright position by a frame 12. A water inlet 13 is provided at the bottom and a water outlet 14, is provided in a side wall at the top. The inlet can be closed by a valve 15. A variable speed propeller means 16 is located within the vessel slightly above the water inlet to increase the water pressure at the bottom and to create an upward water flow toward the outlet 14.

The propeller means 16 includes two upper propeller blades 18 rotatable about the central longitudinal axis of the vessel 10 and having a pitch such that they form an angle of about 15 to 22.5 degrees with the horizontal. Two lower propeller blades 19 positioned immediately below the upper blades and rotatable about the same axis have a length slightly greater than half that of the upper blades and a pitch such that they form an angle of about 30 degrees with the horizontal. The principal purpose of the lower propeller is to stir the water at the bottom of the vessel 10. The upper and lower propellers are driven via a shaft 20 by a variable speed motor 21 supported by the frame 12 beneath the lower end 11 of the vessel.

A removable screen 22 is positioned horizontally across the vessel 10 between the propeller means 16 and the outlet 14 to influence the water flow and create a relatively quiescent zone at the top of the vessel in a manner described more fully below. The preferred position of the screen is at a level one-third of the distance from the bottom of the vessel to the outlet, but the optimum position depends upon the characterisitcs of the ore and other parameters. The position of the screen can be made adjustable for this reason. Preferably, the screen is 4 to 8 mesh, but a finer mesh such as 20 or 30 can be used.

The metal that is to be concentrated by the operation of the apparatus is typically found in only a minority of the severed ore particles. The objective is to separate the ore into gangue, which contains little or none of the metal, and concentrate, which includes the metal-bearing particles and therefore a much higher percentage of metal than the unbeneficiated ore.

The screen 22 is removed and loose, granular, severed ore, the particle size of which should be as uniform as possible, is placed in the bottom of the vessel 10. The screen is then replaced and rotation of the propellers is commenced. The effect of the rotating propeller blades 18 and 19 is to produce a swirling upward flow of the water and to prevent the ore from settling in the bottom of the vessel. Water is continuously supplied at a controlled rate to the vessel inlet 13 as it flows out through the outlet 14.

The water imparts an upward movement to the ore particles. Although this movement is imparted to all particles, those having a lower specific gravity tend to rise higher and faster. Thus, a vertical separation tends to occur between particles which contain significant quantities of metal and those which do not. As the rotation of the propellers continues, more and more of the lighter nonmetalic particles rise to a level of the outlet 14 and are carried away as gangue while the particles remaining in the vessel 10 form concentrate. Separation can be maximized by adjusting the rate of water flow and the propeller speed, although the optimum rate and speed depend upon the properties of the particular ore being processed, the dimensions of the vessel and the configuration of the propellers. Speeds between 200 and 1200 rpm have generally been found satisfactory.

The ore particles are given considerable momentum at the bottom of the vessel in the vicinity of the propellers, but the forces acting on them diminish as they move upwardly toward the outlet 14. The function of the screen 22 is to minimize differences in water pressure in the portion of the vessel 10 above the screen and inhibit rotational flow of the water in that upper zone. The quiescence of the upper zone thus further contributes to vertical separation since the heavier metal bearing particles cannot continue to move upwardly toward the outlet under the diminished force of the propeller means in the area above the screen.

Once the separation process has been completed, the concentrate can be removed from the bottom of the vessel 10 by a suction pump. Alternatively, the concentrate can be removed through a second outlet 26 at the bottom of the vessel 10 opposite the inlet 13 or through a door in the vessel. The second outlet is closed by a valve 28 while the gangue is being separated.

Typically, the weight of the concentrate recovered at the completion of the process is only about 20 to 25 percent or less that of the unbeneficiated severed ore but the concentrate contains 90 to 97 percent of the metal originally present in the severed ore. If desired, the process can be repeated, preferably in a smaller vessel where finer control and more uniform conditions can be maintained, to produce further concentration of the metal.

Severed ore, as it is supplied for beneficiation, sometimes coheres as large clumps even though the separate particles that form the clumps are relatively small. This is particularly true when the ore has been moistened prior to the beneficiation process. It has also been found that severed ore, particularly if it has not been screened, may contain relatively large pieces of foreign matter such as twigs and leaves. When these conditions exist, it is desirable to break up the clumps and remove the foreign matter prior to the beneficiation process described above. This objective can be accomplished by the same apparatus that is used later for beneficiation.

The ore is first placed on top of the screen 22, and the propellers 16 and 18 are run at high speed. The resulting strong water currents agitate the ore to break up any clumps. When the rotation of the propellers is slowed down or stopped, the ore particles sink through the screen to the bottom of the vessel. The screen is then removed and the foreign matter found on top is discarded. The apparatus can be operated in the usual mode to separate gangue after the screen has been replaced. In some situations it may be desirable to use a finer mesh screen to separate foreign matter, and to replace it with a coarser mesh screen to better equalize water pressure during the separation stage of the process.

Figure 3:
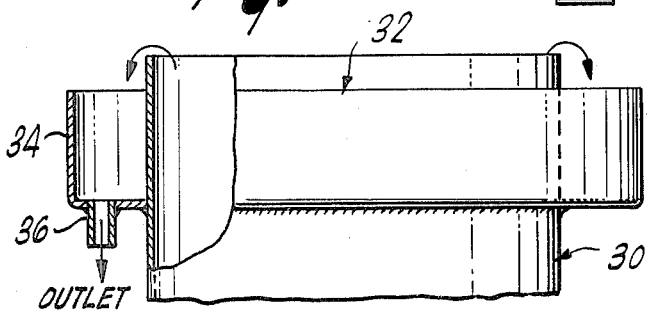
FIG. 3 is an enlarged cross-sectional side view showing an apparatus similar to that of FIG. 2 which also embodies the invention.

A variation of the invention, illustrated in FIG. 3, avoids the asymmetrical horizontal currents at the top of the vessel 10 caused by the outlet 14 which may tend to have a mixing effect that hinders separation. The vessel 30 has an open top end 32 that serves as the outlet, and the upwardly flowing water overflows the entire perimeter of the vessel into an external annular collar 34 just below the open end. The collar is continuously emptied by a drain 36. The remaining components of this apparatus are the same as those described above in connection with the vessel 10 having an outlet 14 at one side and it is operated in the same way.

The apparatus of this invention may be of almost any size desired depending upon the quantities of ore to be processed. A large apparatus for use at a copper mine may be, for example, 12 to 15 feet in diameter to process upwards of 100 tons of severed ore per hour. On the other hand, it can be as small as a desk top device for use by assayers. Generally it is best to employ a vessel having a height approximately three times its diameter, although this proportionality may be varied. The optimum size of the propellers in relation to the diameter of the vessel depends upon the characteristics of the ore to be processed, but their size is usually not critical because compensation can be made by varying the propeller speed. By way of example, however, satisfactory performance has been achieved in a vessel 33 inches in diameter using upper propellers 7 inches in diameter and lower propellers 4 inches in diameter.

In the smaller size range, it is desirable to make the cylindrical walls of the vessel 10 of transparent plastic so that the operator can view the effect on the ore as he adjusts the propeller speed. In the case of large installations, metal walled vessels will be found less expensive and more durable, and the optimum propeller speed can be determined best by experimentation.

The apparatus and method described above permit the beneficiation of severed ore with much greater efficiency than is possible when using previously known techniques. Accordingly, it will not only increase the efficiency of presently operating large mines, but may make possible the working of smaller mines and those that have low grade ore from which metal cannot be extracted economically using conventional techniques. In addition, the apparatus is simple and relatively inexpensive, and can be constructed in virtually any size desired.

While several particular forms of the invention have been illustrated and described, it will also be apparent that various modifications can be made without departing from the spirit and scope of the invention.

I claim:

1. A beneficiation method not of the froth flotation type for separating severed ore into relatively heavy concentrate and relatively light gangue comprising:

placing severed ore in a vessel having an inlet at the bottom and an outlet at the top;

placing a horizontal screen without substantial vertical dimension across the vessel between the inlet and the outlet to define an upper zone of the vessel above the screen, the ore being initially disposed below the screen;

supplying water free of injected gases to the vessel through the inlet;

rotating a propeller in the vessel beneath the screen as the water is supplied and thereby causing said gas free water to flow upwardly from the inlet through the screen to the outlet carrying concentrate and gangue through the screen into the upper zone, whereby the presence of the screen minimizes the rotational flow of water and equalizes the water pressure in the upper zone, the gangue being carried upwardly and through the outlet by the water, while the concentrate remains in the vessel and moves downwardly through the screen due to its higher specific gravity; and removing the concentrate from the vessel.

2. The method of claim 1, wherein the screen is of about 4 to 30 mesh.

3. The method of claim 1, wherein the screen is placed at a level approximately one-third of the distance from the bottom of the vessel to the outlet.

4. The method of claim 1, further comprising the step of adjusting the speed of the propeller to obtain maximum vertical separation of gangue from concentrate.

5. The method of claim 1, further comprising rotating a second propeller of greater pitch than the afore-mentioned propeller at a location below the afore-mentioned propeller to prevent ore from settling at the bottom of the vessel.

* * * * *